US005269039A

United States Patent [19]

Isaac

[11] Patent Number: 5,269,039

[45] Date of Patent: Dec. 14, 1993

[54] SECTIONAL PAINT ROLLER ASSEMBLY

[75] Inventor: Gregory J. Isaac, Laguna Hills, Calif.

[73] Assignee: Corcoran Manufacturing Company, Inc., Anaheim, Calif.

[21] Appl. No.: 880,541

[22] Filed: May 8, 1992

[51] Int. Cl.[5] ..... B05C 17/02

[52] U.S. Cl. ..... 15/230.11; 492/19; 492/39; 492/41

[58] Field of Search ..... 15/230.11; 492/19, 29, 492/39, 40, 41

[56] References Cited

U.S. PATENT DOCUMENTS

| | | | |
|---|---|---|---|
| 2,803,126 | 8/1957 | Meyer | 492/40 |
| 2,805,439 | 10/1957 | Parker | 15/230.11 |
| 2,977,671 | 4/1961 | Wiegand | 492/19 |
| 3,711,887 | 1/1973 | Chapman | 15/230.11 |
| 3,714,674 | 2/1973 | Simoncioni | 15/230.11 |
| 4,416,201 | 11/1983 | Kessler | 492/40 |
| 4,872,247 | 10/1989 | Nakamura | 492/39 |
| 4,985,959 | 1/1991 | Lieberman | 15/230.11 |

FOREIGN PATENT DOCUMENTS

| | | | |
|---|---|---|---|
| 3410468 | 9/1985 | Fed. Rep. of Germany | 15/230.11 |
| 3903519 | 8/1990 | Fed. Rep. of Germany | 15/230.11 |
| 1393923 | 2/1965 | France | 15/230.11 |
| 2593725 | 8/1987 | France | 15/230.11 |

OTHER PUBLICATIONS

1991 Corcoran Manufacturing Company, Inc. catalog of 4. pgs., Catalog #5, Dec. 1990.

*Primary Examiner*—Harvey C. Hornsby
*Assistant Examiner*—Randall E. Chin
*Attorney, Agent, or Firm*—Stetina and Brunda

[57] ABSTRACT

A sectional paint roller tube for attachment to a paint roller axle. The roller tube of the present invention has a cylindrical, substantially hollow, endpiece having an opening formed in one end thereof; at least one split sleeve having an inner diameter sized to frictionally engage the paint roller axle and an outer diameter sized to be rotatably received within the endpiece; and a cylindrical, substantially hollow, cap having an opening extending therethrough. One or more extensions may be attached to the endpiece such that an assembled roller tube of a desired length is fabricated. The cap is attached directly to the endpiece if no extensions are utilized, and is attached to the final extension if one or more extensions are used. Thus, by utilizing a small number of standard parts, paint rollers of a wide variety of different lengths are fabricated. This eliminates the need to design and fabricate molds for various lengths of roller tubes, eliminates the requirement for inventorying various lengths of roller tubes, and simplifies the assembly process by eliminating the requirement for a given size roller tube in the construction of a paint roller of a desired length. The split sleeve both functions as a bushing upon which the roller rotates about the axle and also as a thrust bearing preventing lateral movement of the roller relative to the axle.

8 Claims, 1 Drawing Sheet

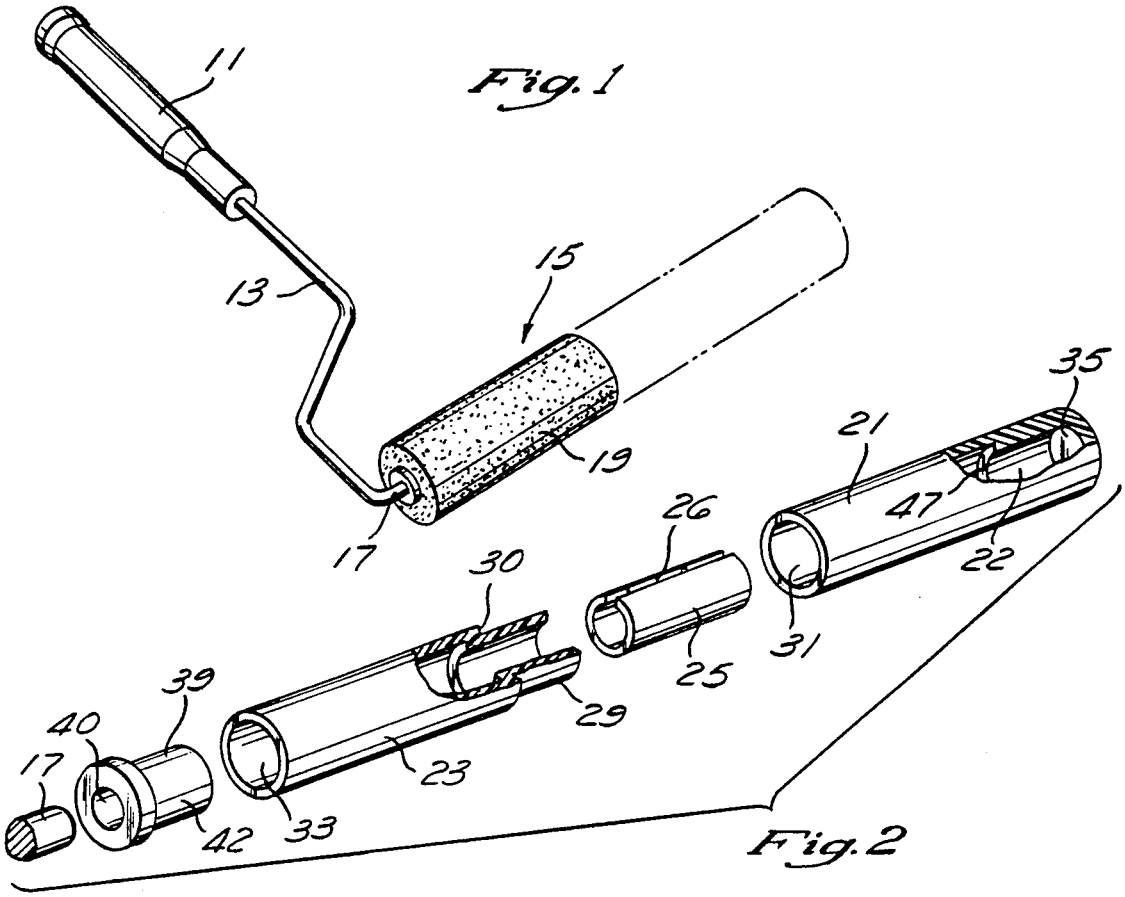
Fig. 1
Fig. 2
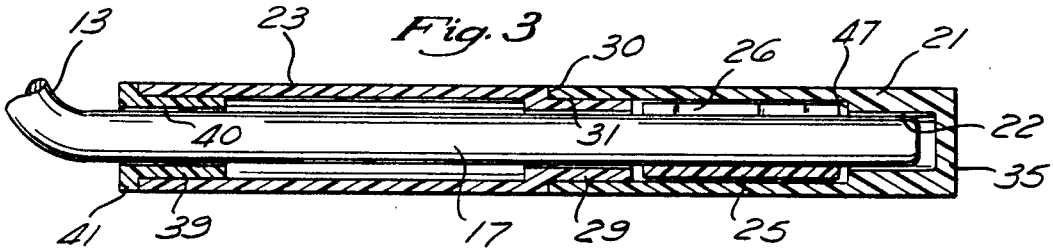
Fig. 3
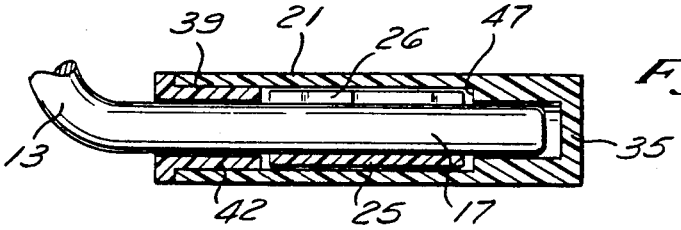
Fig. 4
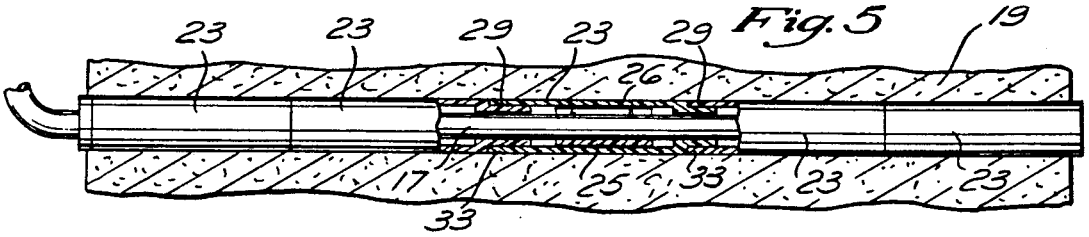
Fig. 5

SECTIONAL PAINT ROLLER ASSEMBLY

FIELD OF THE INVENTION

The present invention relates generally to paint applicators and more particularly to a sectional paint roller assembly wherein rollers of various lengths may be economically manufactured and assembled utilizing a minimum number of different standard parts.

BACKGROUND OF THE INVENTION

Paint rollers for applying paint to various surfaces are well known. Such rollers have generally replaced brushes for many painting tasks. Rollers are particularly effective where large areas require painting. Rollers possess several advantages over paint brushes. Less frequent dipping into the paint is generally required when utilizing rollers because of the reservoir action afforded by the roller as opposed to paint brushes. Additionally, the surface of rolled paint is generally smoother than that of brushed paint and lacks the brush marks commonly associated with the brushing process.

Paint rollers generally comprise two different types, fabric and foam. Foam rollers generally provide a smoother finish, conform better to surface irregularities, and hold more paint than fabric rollers. They thus generally require less frequent dipping than fabric rollers.

Rollers are generally constructed by applying either fabric or foam to a tubular member or roller tube, generally comprised of a polymer material. The roller tube must necessarily be of the correct length such that a finished roller of a desired size is provided. Thus, the fabrication of a roller of any given length requires a corresponding roller tube of that length such that a manufacturer is required to fabricate, inventory, and assemble roller tubes of the various sizes corresponding to the finished products.

For example, a manufacturer offering paint rollers of 2, 4, 6, and 8 inch lengths requires roller tubes of four different corresponding lengths. Each length must be separately manufactured and thus requires dedicated tooling. Each length must be separately inventoried, thus requiring storage space and inventory control. Additionally, each length must be separately assembled, requiring the correct length tube for the desired finished product. Thus, a manufacturer must contend with a variety of different roller tube lengths, thereby increasing the complexity and cost associated with paint roller manufacturing.

Although such prior art paint rollers have proven generally suitable for their intended purposes, they thus possess inherent deficiencies which detract from their overall effectiveness in the marketplace. As such, it is desirable to provide a simplified roller such that various roller lengths may be economically manufactured and assembled utilizing a minimum number of different standard parts, thereby reducing the costs associated with the fabrication, inventory, and assembly of such paint rollers.

SUMMARY OF THE INVENTION

The present invention specifically addresses and alleviates the above mentioned deficiencies associated in the prior art. More particularly, the present invention comprises a sectional paint roller tube for attachment to a paint roller axle. The roller tube of the present invention comprises a cylindrical, substantially hollow endpiece having an opening formed in one end thereof; at least one split sleeve having an inner diameter sized to frictionally engage the paint roller axle and an outer diameter sized to be rotatably received within the endpiece; and a cylindrical, substantially hollow cap having an opening extending therethrough. One or more extensions may be attached to the first endpiece such that an assembled roll of a desired length is fabricated.

The cap is attached directly to the first endpiece if no extensions are utilized, and is attached to the final extension if one or more extensions are used. Thus, by utilizing a small number of standard parts, paint rollers of a wide variety of different lengths may be fabricated. This eliminates the need to design and fabricate molds for various lengths of rollers, eliminates the requirement for inventorying various lengths of rolls, and simplifies the assembly process by eliminating the requirement for a given size tube in the construction of a paint roller of a desired length. Thus, when a manufacturer desires a roller of a new length, it is possible for the manufacturer to assemble the new roller from existing standard parts, thus eliminating the need to incur tooling costs and time delays in order to fabricate a new product.

The split sleeve both functions as a bushing upon which a roller tube rotates about the axle and also as a thrust bearing preventing lateral movement of the roller relative to the axle. The split sleeve frictionally engages and securely grasps the axle inserted therethrough such that the split sleeve captures the axle within the roller tube. The split sleeve then remains stationary along with the axle and functions as a bushing by contacting the inner surface of the substantially hollow endpiece or extension within which the split sleeve is disposed. The split sleeve is configured to have an outer diameter greater than the opening in the cap or extension through which the axle is inserted such that the split sleeve is captured thereby.

Although those skilled in the art will recognize that endpieces and extensions of various lengths are suitable, the endpieces and extensions of the present invention are preferably between approximately one and two inches in length. Optionally, both one and two inch lengths may be utilized. The use of two inch lengths facilitates the fabrication of paint roller tubes having total lengths which are approximately a multiple of two inches, e.g., 6, 8, 10, and 12 inches in length. The use of one inch lengths, either alone or in combination with two inch lengths, facilitates the fabrication of paint roller tubes having lengths which are equal to an integral number of inches, e.g., 7, 8, 9, and 10 inches.

These as well as other advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 1 is a perspective view of a sectional paint roller assembly according to the present invention;

FIG. 2 is an exploded view, partially in section, of the paint roller tube of FIG. 1;

FIG. 3 is a cross-sectional side view of the paint roller of FIG. 2 assembled and installed upon an axle;

FIG. 4 is a cross-sectional side view of a paint roller utilizing only an endpiece and a cap, and not utilizing any extensions; and FIG. 5 is a side view, partially in cross-section, illustrating a sectional paint roller assembly comprising an endpiece, four extensions, and a cap.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

The sectional paint roller assembly of the present invention is illustrated in FIGS. 1–5 which depict a presently preferred embodiment of the invention. Referring now to FIG. 1, a paint roller assembly generally comprises a handle 11, frame 13, axle 17, and a roller tube 15 rotatably attached to the axle 17. A cover 19, typically comprised of fabric or foam, is formed about the outer surface of the roller tube 15. The roller tube 15 will be of a desired length, typically 2, 4, 6, or 8 inches, although those skilled in the art will recognize that various other lengths are likewise often desirable and suitable.

Referring now to FIGS. 2 and 3, the sectional paint roller tube of the present invention comprises a first endpiece 21 having an opening or female attachment member 31 formed in one end thereof and preferably having a cover 35 formed in the opposite end thereof. A shoulder 47 is formed approximately two-thirds of the distance between the opening 31 and the cover 35 where the diameter of the endpiece 21 decreases. An area of reduced diameter or bore 22 has a diameter somewhat larger than the outer diameter of the axle 17 such that the endpiece 21 may rotate thereupon. The endpiece 21 is preferably between approximately one and two inches in length, preferably being supplied in both one and two inch lengths. Those skilled in the art will recognize that various other lengths are likewise suitable.

A split sleeve 25 has a split 26 formed along its entire length and has an inner diameter sized somewhat smaller than the outer diameter of the axle 17 such that it will snugly grasp the axle 17 when applied thereto. Thus, those skilled in the art will recognize that various inner diameters of the split sleeve 25 may be formed to compliment various diameters of axle 17. The split sleeve 25 has an outer diameter sized somewhat smaller than the inner diameter of the opening or female attachment member 31 in the endpiece 21 such that the endpiece 21 can rotate thereabout when the split sleeve 25 is disposed about the axle 17, within the endpiece 21.

An extension 23, like the endpiece 21, has a female attachment member 33 formed in one end thereof. Formed in the opposite end thereof is a male attachment member 29 which comprises a region of reduced diameter sized to be snugly received by and to frictionally engage female attachment member 31 in the endpiece 21 or the female attachment member 33 of another extension 23. That is, the male attachment member 29 and the female attachment member 33 of extension 23 are formed in a complimentary fashion such that a plurality of such extensions 23 may be attached, end to end, to obtain a roller 15 of a desired length. A shoulder 30 formed upon the extension 23 serves as a stop to limit insertion of the male attachment member 29 into the female attachment member 33. Like the endpiece 21, extension 23 is preferably between approximately one and two inches in length, preferably being supplied in both one and two inch lengths, although those skilled in the art will recognize various other lengths are likewise suitable.

A cap 39 has a central bore 40 formed therethrough. Like the bore 22 of the endpiece 21, the bore 40 in the cap 39 is sized to be somewhat larger in diameter than the outer diameter of the axle 17 such that the cap 39 may rotate thereon.

Referring now to FIG. 4, the endpiece 21 and cap 39 may be directly attached together by inserting the male member 42 of the cap 39 into the female attachment member 31 of the endpiece 21. Such construction, lacking the use of any extensions 23, therefore results in the shortest possible roller 15 according to the present invention.

Referring now to FIG. 5, a plurality of extensions 23 may be stacked by inserting the male attachment members 29 thereof into the female attachment members 33 of adjacent extensions 23. The male attachment member 29 of the final extension 23 is inserted into the female attachment member 31 of the endpiece 21. Thus, a roller of an increased length may be fabricated. Additional split sleeves 25 may optionally be captured within the extensions 23.

Various means, i.e. ultrasonic welding, heat bonding, adhesive bonding, may be utilized to permanently attach the first endpiece 21 to the cap 39 or any extensions 23, and to attach any extensions 23 together, as well as to attach the cap 39 to any extensions 23. Alternatively, the male attachment members 29 and 42 and the female attachment members 31 and 33 may be sized to facilitate a press fit which securely attaches the desired parts together. A cover 19 of either fabric or foam may be applied about the roller 18 after assembly thereof.

It is understood that the exemplary sectional paint roller assembly of the present invention described herein and shown in the drawings represents only a presently preferred embodiment of the invention. Indeed, various modifications and additions may be made to such embodiment without departing from the scope and spirit of the invention. Various configurations of the male and female attachment members are contemplated. For example, each attachment member could be formed to have complimentary hexagonal cross-sections. Optionally, various detent arrangements could be formed upon the male and female attachment members to ensure secure attachment thereof. Thus, these and other modifications and additions may be obvious to those skilled in the art and may be implemented to adapt the present invention for use in a variety of different applications.

What is claimed is:

1. A sectional paint roller tube for attachment to a paint roller axle, said roller comprising:

a) a generally cylindrical, substantially hollow, endpiece having an inner diameter and having an opening formed in one end thereof;

b) a generally cylindrical, substantially hollow cap, having an opening extending therethrough;

c) at least one split sleeve having inner and outer diameters, the inner diameter of said split sleeve sized to frictionally engage the paint roller axle and the outer diameter of said split sleeve sized to be rotatably received within said endpiece;

d) at least one extension attachable to said endpiece, said extension having an inner diameter sized to rotatably receive a split sleeve;

e) wherein said endpiece is attachable to said cap, capturing said split sleeve within said endpiece, to retain the paint roller tube upon the axle; and f) wherein a number of extensions may be attached together and attached to said endpiece, and capturing additional split sleeves within a number of said extensions, to form a paint roller tube of a desired length.

2. The sectional paint roller assembly of claim 1 wherein said extensions are between approximately one and two inches in length.

3. The sectional paint roller assembly as recited in claim 1 wherein said at least one extension is approximately one inch in length.

4. The sectional paint roller assembly as recited in claim 1 wherein said at least one extension is approximately two inches in length.

5. A paint roller assembly comprising:

a) a handle;

b) a frame formed on said handle;

c) an axle formed on said frame;

d) a first generally cylindrical, substantially hollow, endpiece having an inner diameter and having an opening formed in one end thereof;

e) a generally cylindrical, substantially hollow cap having an opening extending therethrough;

f) at least one split sleeve having inner and outer diameters, the inner diameter of said split sleeve sized to fractionally engage the paint roller axle and the outer diameter of said split sleeve sized to be rotatably received within said first endpiece; and g) at least one extension attachable to said endpiece, said extension having an inner diameter sized to rotatably receive a split sleeve;

h) wherein said first endpiece may be attached to said cap, capturing said split sleeve within said endpiece; and i) wherein a number of extensions may be attached together and attached to said endpiece and capturing additional split sleeves within a number of said extensions, to form a paint roller tube of a desired length.

6. The sectional paint roller assembly of claim 5 wherein said extensions are between approximately one and two inches in length.

7. The sectional paint roller assembly as recited in claim 5 wherein said at least one extension is approximately one inch in length.

8. The sectional paint roller assembly as recited in claim 5 wherein said at least one extension is approximately two inches in length.

* * * * *